US006892398B2

(12) United States Patent
Wilson

(10) Patent No.: US 6,892,398 B2
(45) Date of Patent: May 17, 2005

(54) FLEXIBLE FIT CAP WITH IMPROVED SWEATBAND

(75) Inventor: Peter L. Wilson, Norman, OK (US)

(73) Assignee: Top of the World Corporation, Norman, OK (US)

( * ) Notice: Subject to any disclaimer, the term of this patent is extended or adjusted under 35 U.S.C. 154(b) by 155 days.

(21) Appl. No.: 10/227,258

(22) Filed: Aug. 22, 2002

(65) Prior Publication Data

US 2003/0037365 A1 Feb. 27, 2003

Related U.S. Application Data

(60) Provisional application No. 60/314,510, filed on Aug. 22, 2001.

(51) Int. Cl.[7] ..... A42B 19/00
(52) U.S. Cl. ..... 2/181; 2/195.3
(58) Field of Search ..... 2/181, 195.1–195.4, 2/183, 181.4

(56) References Cited

U.S. PATENT DOCUMENTS

| | | | | | |
|---|---|---|---|---|---|
| 4,833,734 | A | | 5/1989 | Der Estephanian | |
| 5,099,524 | A | | 3/1992 | Linday | |
| 5,428,843 | A | | 7/1995 | Clowers et al. | |
| 5,566,395 | A | | 10/1996 | Nebeker | |
| 5,615,415 | A | | 4/1997 | Beckerman | |
| 5,715,540 | A | * | 2/1998 | Cho | 2/195.3 |
| 5,887,284 | A | * | 3/1999 | Simmons | 2/181.4 |
| 5,966,742 | A | * | 10/1999 | Cunliffe | 2/195.3 |
| 5,983,398 | A | * | 11/1999 | Kronenberger | 2/181 |
| 6,016,572 | A | * | 1/2000 | Park | 2/195.2 |
| 6,049,911 | A | | 4/2000 | Bromberg | |
| 6,067,658 | A | | 5/2000 | Cho | |
| 6,122,774 | A | * | 9/2000 | Park | 2/181 |
| 6,336,224 | B1 | | 1/2002 | Wang | |
| 6,339,844 | B1 | | 1/2002 | Merkley | |
| 6,347,410 | B1 | | 2/2002 | Lee | |

* cited by examiner

*Primary Examiner*—Katherine M Moran
(74) *Attorney, Agent, or Firm*—Crowe & Dunlevy, P.C.

(57) ABSTRACT

A cap is provided that includes a crown that is substantially hemispherical in shape and configured to receive the head of a wearer and an unfolded sweatband connected to the inside bottom edge of the crown. The sweatband is preferably unfolded and constructed from the same material used to construct the crown. The sweatband can include a front portion and a back portion, which are connected by a seam cover.

15 Claims, 3 Drawing Sheets

FLEXIBLE FIT CAP WITH IMPROVED SWEATBAND

RELATED APPLICATIONS

This application claims priority to U.S. Provisional Patent Application No. 60/314,510 filed Aug. 22, 2001, entitled "Cap with Seam Covers."

FIELD OF THE INVENTION

The present invention relates generally to the field of headwear. The invention more particularly provides a flexible fit cap with an improved sweatband.

BACKGROUND OF THE INVENTION

The design of headwear, and baseball caps in particular, has evolved over time in response to advances in plastics and textiles, changes in fashion trends and the availability of sophisticated manufacturing facilities. Despite the wide variation in design, most caps share several common features. As shown in FIG. 1, most prior art caps include a crown 10 for receiving the wearer's head and a brim or bill 12 extending from the crown 10. The crown 10 is typically constructed from a number of connected gores 14 that form the substantially hemispherical shape of the cap 10. In some cases, the gores 14 are fabricated from an elastic material that is designed to stretch to fit the wearer's head.

Most prior art caps also include a sweatband 16 that is circumferentially disposed along the inside of the bottom of the crown 10. The sweatband 16 generally serves to hold the cap in position upon the wearer's head, but may serve additional functions, such as perspiration absorbency. When a cap is intended to provide a flexible fit, the sweatband 16 can also include an elastic material that enables stretching during use.

In some cases, it is desirable to use sweatbands that include multiple components that are connected to form a continuous band. For example, as shown in the prior art cap of FIG. 2, it may be desirable to incorporate an elastic band in a back portion 18 of the sweatband 16 and a padded, absorbent band in a front portion 20 of the sweatband 16. Typically, the front portion 20 and the back portion 18 overlap on opposite sides of the cap and are stitched together along a sweatband seam 22.

The prior art methods of attaching the front portion 20 to the back portion 18 suffer from several deficiencies. For example, overlapped portions of the sweatband 16 press against the wearer's head during use, thereby causing discomfort. Additionally, the exposed stitching is unsightly and detracts from the aesthetic qualities of the hat. Furthermore, the repetitive contact between the wearer's head and the exposed stitching along the sweatband seam 22 can degrade the stitching over time, increasing the chance of separation between the separate portions of the sweatband.

It is also known in the art to form at least some portion of the sweatband by inwardly folding the lower portions of the gores 14 within the crown 10, as shown in FIG. 2. This design generally benefits from lower material and labor costs. Although cheaper to manufacture, this sweatband design suffers several drawbacks.

For example, adjacent gores 14 are typically joined together at a gore seam 24, which is buttressed with a gore seam brace 26. When the gores 14 are inwardly folded, the underside of the gore seam 24 is revealed and placed in direct contact with the wearer's head. Additionally, the folded gore seam brace 26 creates lumps in the sweatband 16 that can cause discomfort to the wearer.

As hat designs have changed over the years, the importance of product branding has become increasingly important. Team logos and company names are among the designs that are frequently affixed to modem headwear. In the prior art, these designs have been limited to placement on the exterior of the crown or bill of the hat.

In light of these and other deficiencies, there exists a need to develop an economic, comfortable and attractive baseball cap that overcomes the deficiencies in the prior art.

SUMMARY OF THE INVENTION

The present invention is directed to a cap that includes a crown that is substantially hemispherical in shape and configured to receive the head of a wearer. The crown preferably includes a plurality of gores, wherein the plurality of gores is constructed from a material that permits lateral stretching about the circumference of the crown. The cap also includes a separate unfolded sweatband connected to the inside bottom edge of the crown. In the presently preferred embodiment, the sweatband comprises a front portion and a back portion. The front portion preferably includes a front contact layer that is constructed from a substantially inelastic material. The back portion preferably includes a rear contact layer that comprises the same material used to construct the plurality of gores.

DETAILED DESCRIPTION OF THE PREFERRED EMBODIMENT

Figure 1:
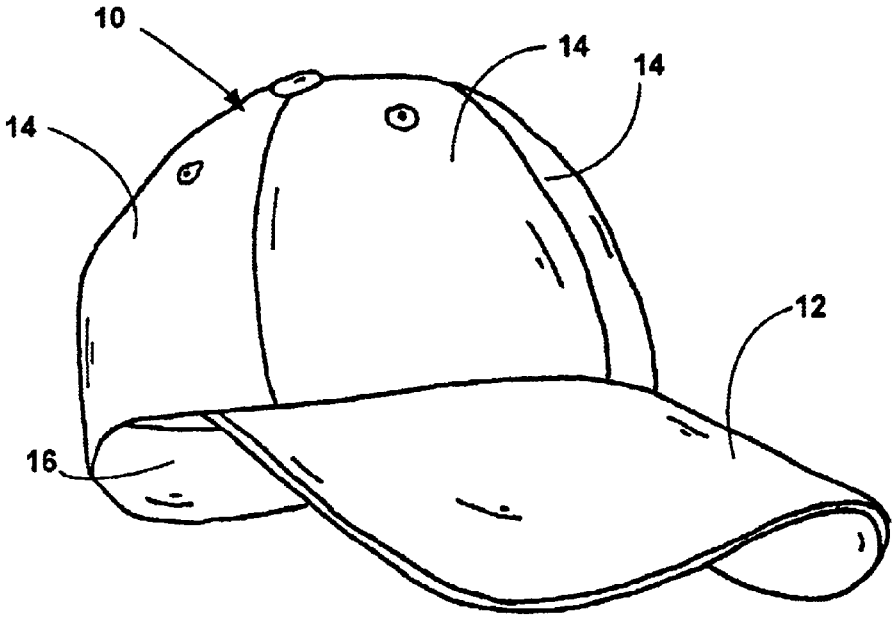
PRIOR ART FIG. 1
FIG. 1 is a front perspective view of a prior art baseball cap.
Figure 2:
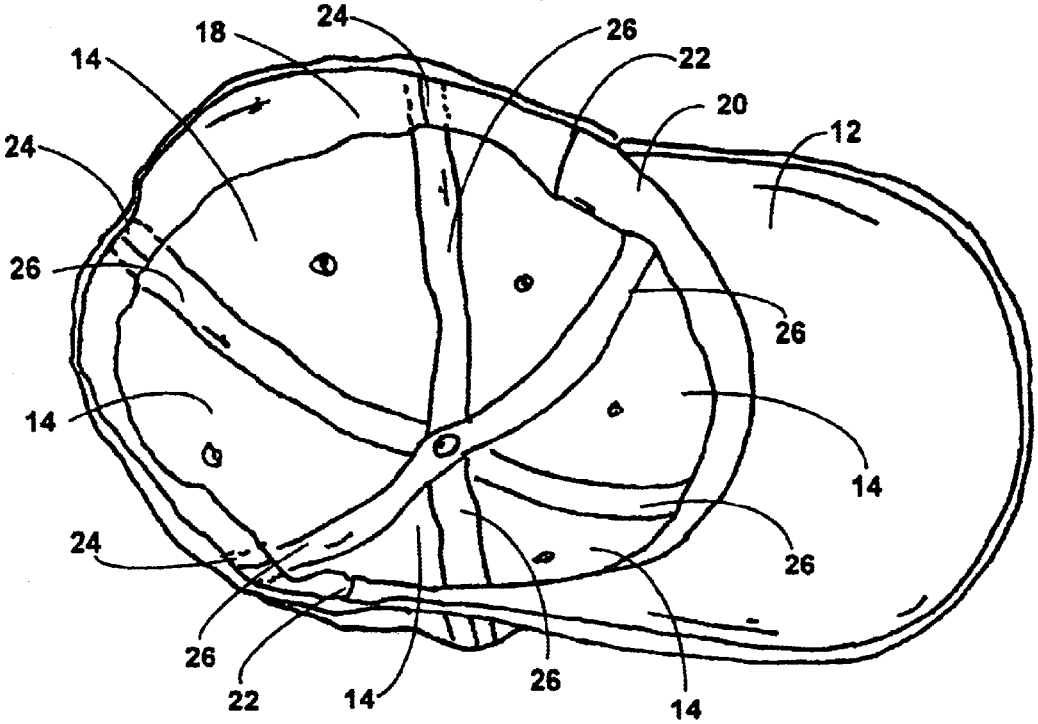
PRIOR ART FIG. 2
FIG. 2 is a bottom view of the prior art baseball cap of FIG. 1.
Figure 3:
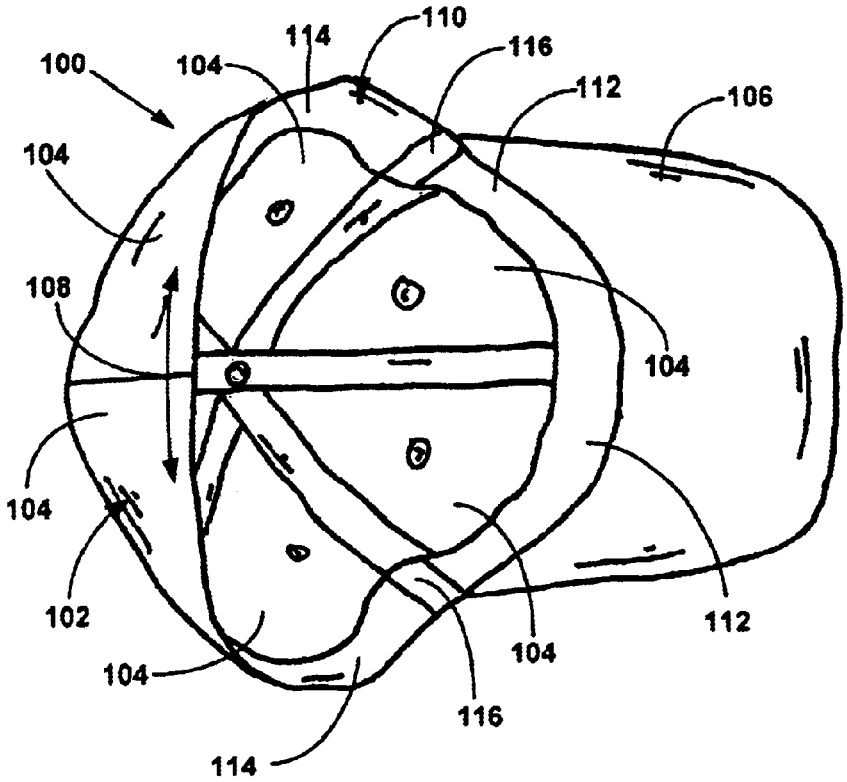
FIG. 3 is a bottom view of a baseball cap constructed in accordance with a preferred embodiment of the present invention.

Referring to FIG. 3, shown therein is a cap 100 constructed in accordance with a preferred embodiment of the present invention. The cap 100 includes a crown 102 constructed from a plurality of substantially triangular gores 104. It will be understood that the crown 102 is adequately shaped and sized to receive the wearer's head. The cap 100 also includes a bill 106 that extends from the front of the crown 102. As shown, the bill 106 is slightly contoured in a parabolic fashion. Although the present invention as described herein is embodied within the cap 100, it will be understood that the present invention can also be applied to other forms of headwear including, but are not limited to, cowboy hats and berets.

In the presently preferred embodiment, the crown 102 is preferably constructed from a material that permits a flexible fit to adjust to the unique size of the wearer's head. To enable lateral stretching about the circumference of the crown 102, as indicated by arrows 108, an elastic fiber is woven into the weft of the material selected to construct the gores 104. Similarly, if a longitudinal flex is desired, an elastic fiber can be woven into the warp of the material used to construct the gores 104. It will be understood that the cap 100 can also be constructed to have both lateral and longitudinal elasticity.

In an another embodiment, the two front gores 104 are lined with a semi-rigid backing that provides structure and shape to the front of the crown 102. In this embodiment, it is not necessary that the two front gores 104 be fabricated from a stretchable material.

Figure 4:
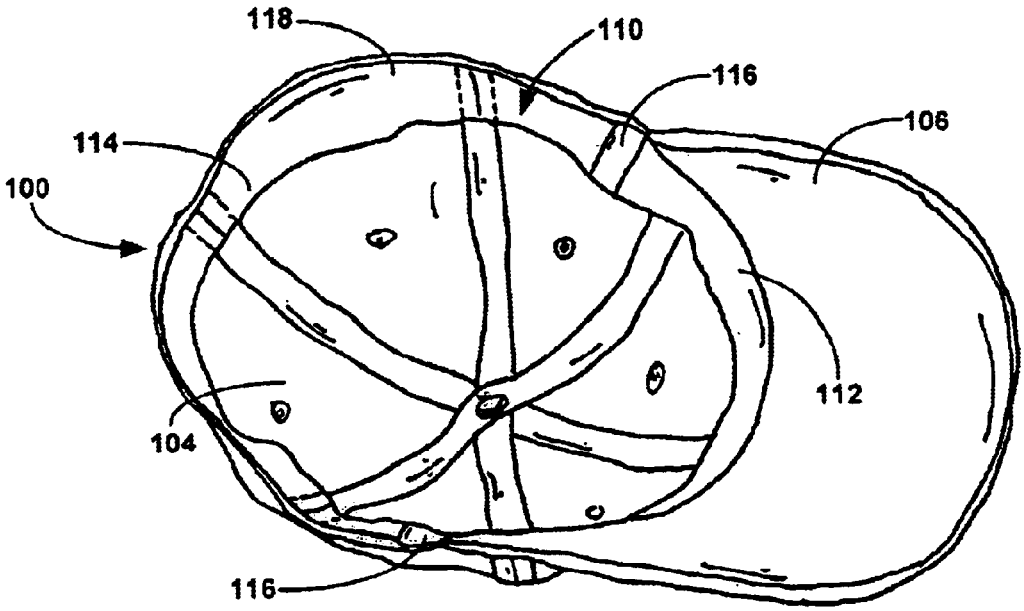
FIG. 4 is a bottom view of the baseball cap of FIG. 3.

Turning to FIG. 4, shown therein is a bottom view of the cap 100. As shown in FIG. 4, the cap 100 further includes a sweatband 110 that is circumferentially disposed about the inside of the bottom edge of the crown 102. In the presently preferred embodiment, the sweatband 110 includes an arcuate front portion 112 connected to an arcuate back portion 114 with a seam cover 116. It is also presently preferred that the sweatband 110 stretch in a circumferential direction, as indicated by arrows 118.

Figure 5:
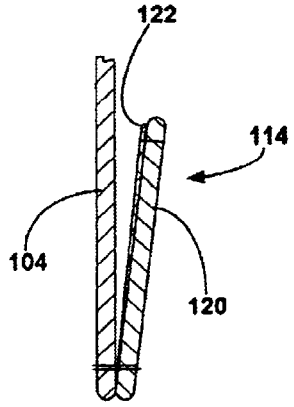
FIG. 5 is a magnified cross-sectional view of a back portion of a sweatband attached to a gore of the cap of FIG. 3.

Referring to FIG. 5, shown therein is a cross-sectional view of the attachment of the back portion 114 attached to the lower inside edge of the crown 102. Preferably, the back portion 114 includes a rear contact layer 120 attached to a concealed elastic support layer 122. The bottom edges of the rear contact layer 120 and elastic support layer 122 are attached to the lower perimeter of the crown 102. The top edges of the rear contact layer 120 and elastic support layer 122 are preferably not sewn to the inside surface of the crown 102.

The rear contact layer 120 is preferably constructed from the same material that is used to fabricate the gores 104. As such, the rear contact layer 120 can be constructed from scrap or other portions of the same material used to construct the gores 104, thereby providing a lower cost of manufacture. Unlike similar prior art sweatbands, however, the rear contact layer 120 is not created by simply folding a portion of the gores 104 inside the crown 102. As such, the rear contact layer 120 does not include gore seams or gore reinforcements that tend to create uncomfortable lumps in the sweatband 110.

The elastic support layer 122 is preferably constructed from thin elastic webbing or spandex. The elastic support layer 122 provides additional structure to the rear contact layer 118 without inhibiting the overall circumferential flexibility of the sweatband 110. In an alternate preferred embodiment, the elastic support layer 122 is not included in the back portion 114.

Figure 6:
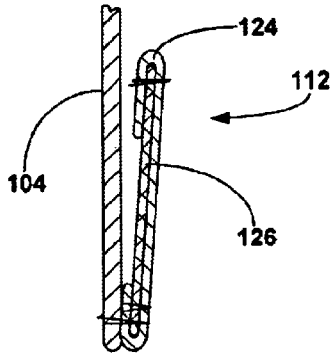
FIG. 6 is a magnified cross-sectional view of a front portion of a sweatband attached to a gore of the cap of FIG. 3.

Turning to FIG. 6, the front portion 112 of the sweatband 110 preferably includes an exposed front contact layer 124 and a concealed backing layer 126. The backing layer 126 can be attached at its top and bottom edges to the mating top and bottom edges of the front contact layer 124. As shown, it is preferred that the front contact layer 124 partially extend around the interior side of the backing layer 126. The lower edges of the front contact layer 124 and backing layer 126 are collectively joined with the lower edge of the crown 102. In an alternate preferred embodiment, the backing layer 126 is not included in the front portion 112.

In the presently preferred embodiment, the front contact layer 124 is constructed from a substantially inelastic woven fabric that exhibits good durability. Unlike conventional knitted sweatbands, the woven front contact layer 124 permits the selective introduction of a design into the woven fabric. When woven as an integrated part of the front contact layer 124, the design does not protrude from the sweatband 110 and is not subject to smearing when contacted with moisture. The backing layer 126 is preferably constructed from a soft, absorbent material.

Figure 7:
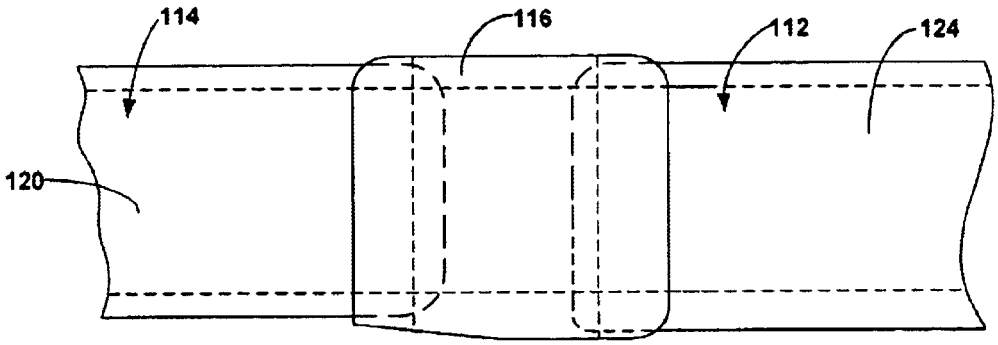
FIG. 7 is an elevational view of the front side of a seam cover at the junction of the back and front portions of the sweatband of the baseball cap of FIG. 3.
Figure 8:
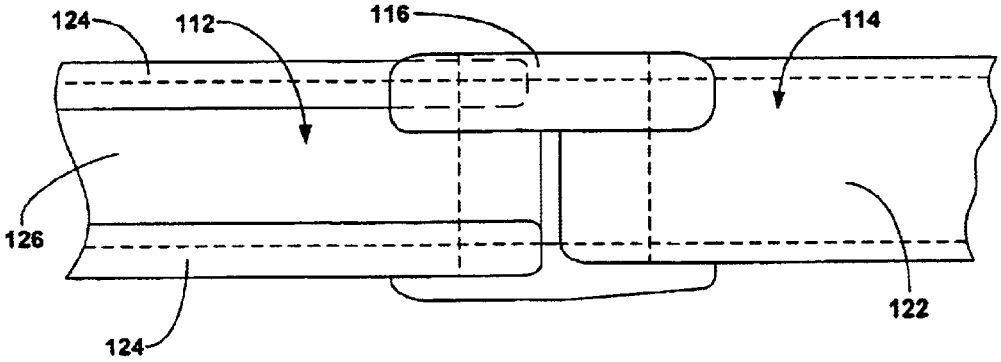
FIG. 8 is an elevational view of the back side of the seam cover of FIG. 7.

As shown in FIGS. 7 and 8, the front portion 112 and the back portion 114 of the sweatband 110 are preferably connected with the seam cover 116. The seam cover 116 is preferably rectangular in shape, having a first side connected to the front portion 112 and an opposed second side connected to the back portion 114. To reduce the thickness of the sweatband 110, it is preferred that the front portion 112 and back portion 114 not overlap. However, to facilitate manufacture, it may be desirable to slightly overlap the front and back portions 112, 114 before affixing the seam cover 116.

It is also preferred that the seam cover 116 have a low profile above the sweatband 116 and be manufactured from a thin piece of fabric that is tear and wear resistant. Suitable fabrics include polyester and nylon blends. In an alternative embodiment, the seam cover 116 can be fabricated from a flexible material that stretches when subjected to a tensile load from the front portion 112 and back portion 114. It will be noted that the seam cover 116 can also be used to display a logo or design.

As shown in FIG. 8, in the presently preferred embodiment the seam cover 116 partially extends from the exposed side of the sweatband 110 to the concealed side. In an alternate embodiment, however, the seam cover 116 extends around the concealed side of the sweatband 110, thereby "sandwiching" the front and back portions 112, 114.

It is clear that the present invention is well adapted to carry out its objectives and attain the ends and advantages mentioned above.

While presently preferred embodiments of the invention have been described in varying detail for the purposes of this disclosure, it will be understood that numerous changes may be made which will readily suggest themselves to those skilled in the art and which are encompassed within the spirit of the invention disclosed and as defined in the appended claims and in the accompanying drawings.

It is claimed:

1. A cap comprising:

a crown that is substantially hemispherical in shape and configured to receive the head of a wearer, wherein the crown includes a plurality of gores, wherein the plurality of gores is constructed from a material that permits lateral stretching about the circumference of the crown; and a separate unfolded sweatband attached to-the bottom edge of the crown, wherein the sweatband comprises:

a front portion, wherein the front portion includes a front contact layer that is constructed from a substantially inelastic material; and a back portion, wherein the back portion includes a rear contact layer that comprises the same material used to construct the plurality of gores.

2. The cap of claim 1, wherein the front portion further comprises a backing layer constructed from an absorbent material.

3. The cap of claim 1, wherein the back portion includes an elastic support layer that provides additional structure to the rear contact layer.

4. The cap of claim 1, wherein the front portion is connected to the back portion with a low profile seam cover.

5. The cap of claim 4, wherein the seam cover is constructed from an elastic material that stretches when subjected to a tensile load.

6. The cap of claim 4, wherein the seam cover is constructed from an inelastic, wear-resistant material.

7. The cap of claim 1, wherein the plurality of gores is constructed from a material that permits longitudinal stretching transverse to the lateral stretching.

8. A cap comprising:

a crown that is substantially hemispherical in shape and configured to receive the head of a wearer, and an unfolded sweatband disposed along the bottom edge of the crown, wherein the sweatband comprises:

a low profile rectangular seam cover;

a front portion connected to a first side of the seam cover, wherein the front portion has an exposed front contact layer and a concealed absorbent backing layer;

a back portion connected to an opposed second side of the seam cover, wherein the back portion has an exposed rear contact layer and a concealed elastic support layer; and wherein the seam cover extends from the exposed front and rear contact layers to the concealed absorbent backing and elastic support layers.

9. The cap of claim 8, wherein the crown is constructed from a material that permits lateral stretching about the circumference of the crown.

10. The cap of claim 8, wherein the crown is constructed from a material that permits longitudinal stretching transverse to the lateral stretching.

11. The cap of claim 8, wherein the front contact layer is constructed from a substantially inelastic, woven material.

12. The cap of claim 8, wherein the front contact layer extends around the interior side of the backing layer.

13. The cap of claim 8, wherein the front contact layer is configured to accept an ornamental design.

14. The cap of claim 8, wherein the back portion includes a rear contact layer that is constructed from the same material used to construct the crown.

15. The cap of claim 8, wherein the seam cover is configured to receive an ornamental design.

* * * * *